United States Patent [19]

Bertalan

[11] Patent Number: 4,887,346

[45] Date of Patent: Dec. 19, 1989

[54] METHOD FOR MAKING AN ULTRA-HIGH FREQUENCY TRANSITION BETWEEN TWO ORTHOGAL GUIDED STRUCTURES AND ULTRA-HIGH FREQUENCY DEVICE WITH A TRANSITION OF THIS TYPE

[75] Inventor: Philippe Bertalan, Sceaux, France

[73] Assignee: Thomson-CSF, Puteaux, France

[21] Appl. No.: 133,736

[22] Filed: Dec. 16, 1987

[51] Int. Cl.[4] ..... H01Q 13/00

[52] U.S. Cl. ..... 29/600; 29/601; 29/830; 29/852; 29/853

[58] Field of Search ..... 29/600, 601, 829, 830, 29/852, 853; 333/34

[56] References Cited

U.S. PATENT DOCUMENTS 3,087,127 4/1963 Borghetti .

FOREIGN PATENT DOCUMENTS 675118 7/1952 United Kingdom .
803626 10/1958 United Kingdom .
1018173 1/1966 United Kingdom .

OTHER PUBLICATIONS

The Journal of The British Institution of Radio Engineers, vol. 21, No. 2, Feb. 1961, pp. 169–189, London, GB; D. J. Doughty: "Waveguide Components—A Survey of Methods of Manufacture and Inspection".

1986 IEEE—MTT—S International Microwave Symposium Digest, Jun. 2–4, 1986, Baltimore, MD., pp. 155, 156, The Inst. of Electrical and Electronics Engineers, Inc., Piscataway, N.J., P. K. Park et al.

Patent Abstracts of Japan, vol. 5, No. 19, (E-44)[691], Feb. 4, 1981; & JP—A-55 147 801 (Hitachi Seisakusho K.K.) 11-18-80.

*Primary Examiner*—Timothy V. Eley

*Attorney, Agent, or Firm*—Oblon, Spivak, McClelland, Maier & Neustadt

[57] ABSTRACT

A method is disclosed for making an ultra-high frequency transition between two orthogonal guided structures and an ultra-high frequency circuit comprising a transition of this type wherein, in a first milling stage, a face is cut out of the mass in the angle formed by a guiding wall of the structure which is orthogonal to the first structure, without any tilting of either of the structures. The invention can be applied to ultra-high frequenices for millimeter waves.

3 Claims, 3 Drawing Sheets

METHOD FOR MAKING AN ULTRA-HIGH FREQUENCY TRANSITION BETWEEN TWO ORTHOGAL GUIDED STRUCTURES AND ULTRA-HIGH FREQUENCY DEVICE WITH A TRANSITION OF THIS TYPE

BACKGROUND OF THE INVENTION

1. Field of the Invention

The present invention pertains to a method for making an ultra-high frequency transition between two orthogonal structures and to an ultra-high frequency circuit with a transition of this type.

2. Description of the Prior Art

In ultra-high frequency equipment for radars, it is necessary to use transitions by which an electromagnetic wave, propagated in a plane that shall be called a horizontal plane, is transferred to an orthogonal, i.e. vertical, guide. An elbow-shaped guide section is generally used for this purpose. Usually, at the right angle formed between a vertical wall and a horizontal wall, either a metallic part is added on to close the angle or the said part is machined in the guide. The said part forms a smooth face with a tilt such that the electrical or magnetic field, which is vertical in the horizontal guide, gradually becomes horizontal in the vertical guide.

For equipment intended to work at frequencies of up to 30 or 40 GHz, conventional techniques are used: either parts of the elbow-shaped guide are milled, the slopes are obtained by inclining the part with respect to the milling tool, or an already bevelled part is added on.

For equipment designed to operate at greater frequencies (corresponding, therefore, to millimeter waves) the problem of machining becomes a predominant one for conventional methods are no longer applicable here. The precision to be obtained is all the greater as the dimensions of the guiding walls are small. The tilting movements to which the part must be subjected, in order to cut out the face by milling it, prove to be incompatible with the required tolerances. This is also the case with the method where an already-machined face is added on.

The present invention removes this disadvantage. It can be used to make ultra-high frequency circuits designed to work, in particular, with millimeter-wave applications where the horizontal guide/vertical guide transitions are made by cutting-out operations in the block without its being necessary to tilt the structures.

SUMMARY OF THE INVENTION

An object of the present invention, therefore, is a method for making an ultra-high frequency transition between two orthogonal guided structures, a method comprising a first machining stage wherein a face is cut out of the block in the angle formed between a guiding wall of the first structure and a guiding wall of the structure orthogonal to this first structure without tilting any of the structures.

Another object of the invention is a method for making an ultra-high frequency transition, a method wherein guiding walls for millimeter waves are made, the said guiding walls having widths and depths compatible with millimeter wavelengths.

BRIEF DESRIPTION OF THE DRAWINGS

The invention will be better understood from the following description of non-exhaustive examples made with reference to the appended drawings, of which:

DESCRIPTION OF PREFERRED EMBODIMENTS

Figure 1:
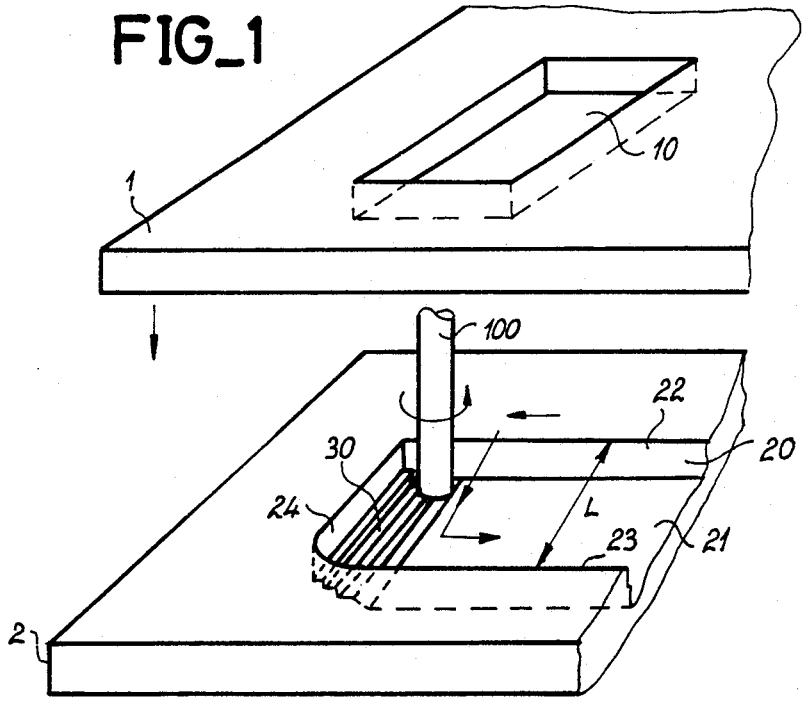
FIG. 1 shows an example of an ultra-high frequency transition according to the method of the invention.

FIG. 1 gives a schematic view of a horizontal guided structure 2 and a vertical guided structure 1. The terms "horizontal" and "vertical", which are used to simplify the description, refer to the planes in which the ultra-high frequency wave is propagated but also refer to an arbitrary choice of the orientation of these structures with respect to a plane of reference (for example the plane of the sheet on which FIG. 1 is shown).

The guided structure called a "vertical" structure is marked 1. It is intended to be set flat against the guided structure, called a "horizontal" structure marked 2.

The vertical guided structure has a conducting plate in which a rectangular opening 10 is machined. This rectangular opening 10 corresponds to a part of a waveguide with side walls. The machining is done through electroerosion by recessing.

For this, an electrode is used. This electrode has the shape of the opening to be made. The structure is placed in an appropriate bath and the application of the electrode to the structure gives the desired cut.

The horizontal guided structure has a conducting plate in which one or more trough-shaped grooves 20 are machined. The grooves are machined in the block. They have a horizontal wall 21 and two vertical walls 22, 23. The machining is done by milling. The milling tool 100 moves horizontally to cut out the groove 20. Then, without any motion of the structure, the milling machine is controlled so as to move in a direction orthogonal to its original direction. It therefore moves along the width L of the groove. Thus the milling tool performs a sequence of to-and-fro-movements to make a corner shaped like a stairway. The steps of the stairway form a face 30 between the horizontal wall 21 and the horizontal wall portion 24.

Figure 2:
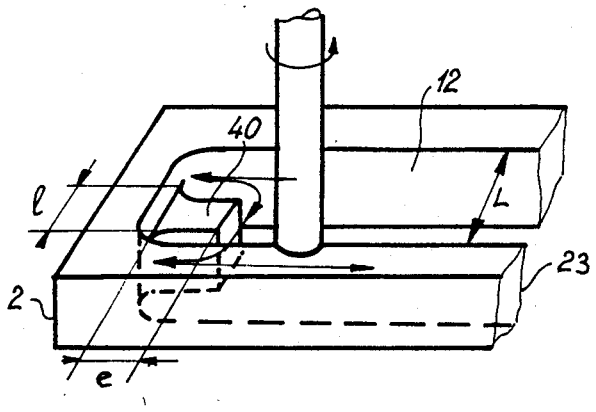
FIG. 2 shows a first stage in the making of the horizontal structure according to an alternative to the method.

FIG. 2 shows a first stage in the making of the face in the horizontal structure according to an alternative to the method.

In this alternative, the face made has a width which is smaller than the width L of the guide. In the first stage, the milling tool is positioned so as to leave a rectangular corner 40 in the angle. For this, the milling tool continues to cut out one of the edges 22 until the desired depth e is obtained. The milling tool is then brought back in front of the corner and moved orthogonally up to the other edge 23. The milling tool is moved along this edge until the desired thickness e is obtained.

Figure 3:
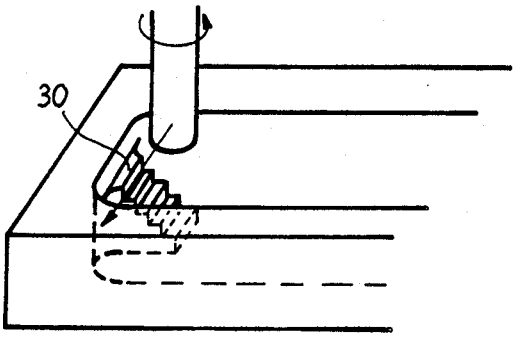
FIG. 3 shows a second stage in the making of the horizontal structure according to the alternative to the method.

FIG. 3 shows the second stage in the making of the face according to a first alternative method. In this second stage, the steps are made by milling the corner 40 so as to obtain a face 30 with the desired slope. The steps are made by successive to-and-fro movements of the milling tool at the corner 40.

Figure 4:
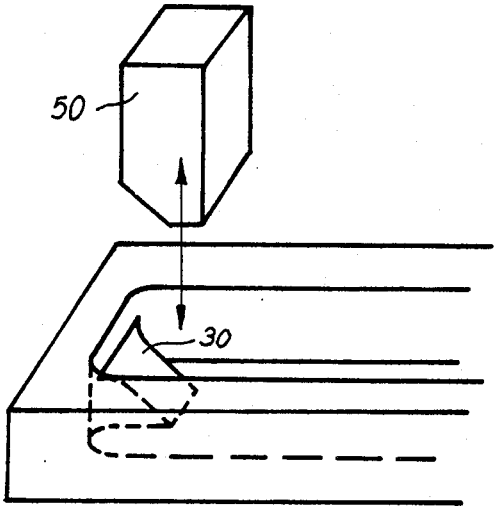
FIG. 4 shows a second stage in the making of the horizontal structure according to another alternative to the method.

FIG. 4 shows a second alternative way of carrying out the second stage. In this alternative, the face 30 is obtained through the electroerosion by recessing of the corner 40 made in the first stage and shown in the FIG. 2. The electroerosion process consists in the use of an electrode 50 that has the shape of the face which is to be made. Since the width l of the face is smaller than the width L of the guide, there is a wider clearance which makes it easier to position the electrode with respect to the face. This characteristic feature prevents any projections into the vertical walls.

Figure 5:
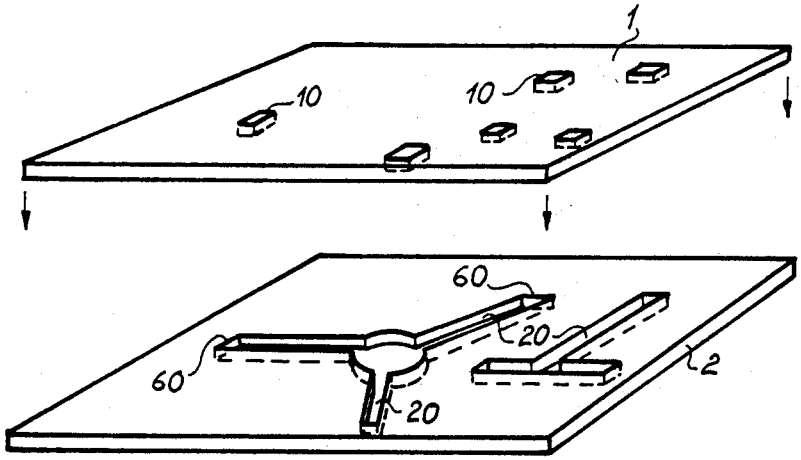
FIG. 5 shows an ultra-high frequency circuit, the transitions of which are made according to the method of the invention.

FIG. 5 shows an ultra-high frequency circuit for millimeter waves with several ultra-high frequency functions. This circuit has several orthogonal transitions made according to the method of the invention. Each opening 10 of the part 1 corresponds to a guide end of the part 2 in which a face has been made according to the FIGS. 2, 3 or 4.

Figure 6:
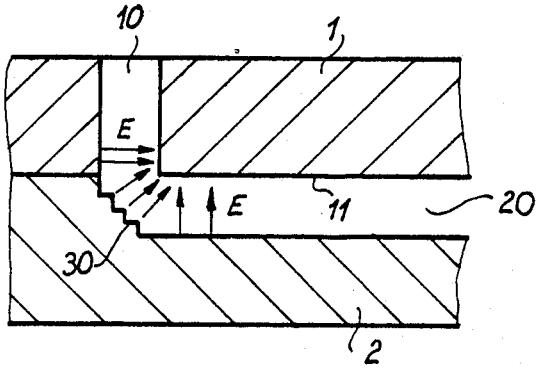
FIG. 6 shows a detail of a sectional view of a transition.

FIG. 6 shows a sectional view of a detail of a face 30. The structures 1 and 2 are superimposed. The wave is propagated in the guide formed by the trough-shaped groove of the structure 2 enclosed by the horizontal wall of the structure 1.

Thus, according to the invention, it is possible, through a milling cutting-out operation, according to the first stage described, to make a face. This face is then subjected either to a second milling operation to cut out steps or to electroerosion by recessing to obtain a bevelled slit in the milled corner.

The milling tool is controlled by a digital control machine which is known per se.

By way of an example, the guides made for transitions of this type may have dimensions of a few millimeters. In a specific example, these dimensions are, for example, a width of 5.7 mm. and a height of 2.8 mm.

What is claimed is:

1. A method for making an ultra-high frequency transition between two orthogonal guided structures comprising the steps of:

in a first milling stage, cutting a face out of the block at the angle formed by a guiding wall of a first structure and a guiding wall of the structure orthogonal to the first structure, without any tilting of either structure, the guiding walls having dimensions that are compatible with millimeter wavelengths, the walls being obtained by making guiding grooves in one of the structures, through milling, by controlling the milling tools so that it moves in to-and-fro motions in a plane along a first direction the face being obtained from a corner left at an end of said guiding groove, controlling the milling tool, in a second milling stage, so that it moves along directions orthogonal to the first direction in and at different depths so that it creates steps in the corner throughout the entire width of the guiding groove.

2. A method for making an ultra-high frequency transition between two orthogonal guided structures comprising the steps of:

in a first milling stage, cutting a face out of the block in the corner formed by a guiding wall of a first structure and a guiding wall of the structure orthogonal to the first structure, without any tilting of either structure, the guiding walls having dimensions compatible with millimeter wavelengths, the walls being obtained by making guiding grooves on one of the structures through milling, by controlling the milling tool so that it moves in to-and-fro motions in a plane along the first direction, the face being obtained from a corner with a width smaller than the width of the guide, left by milling in an end of the guiding groove, moving the milling tool in a second milling stage on the corner in directions orthogonal to the first direction and at different depths so as to make steps.

3. A method for making an ultra-high frequency transition between two orthogonal guided structures comprising the steps of:

in a first stage cutting a face out of the block in the corner formed by a guiding wall of a first structure and a guiding wall of the structure orthogonal to the first structure, without any tilting of either structure, the guiding walls having dimensions compatible with millimeter wavelengths, the walls being obtained by making guiding grooves on one of the structure, through milling, by controlling the milling tool so that it moves in to-and-fro motions in a plane along a first direction the face being obtained from a corner with a width smaller than the width of the guide, left by milling in an end of the guiding groove, applying an electroerosion process, in a second stage, to the corner to make an inclined plane using an electrode which has the shape that is sought to be given to the face.

* * * * *